United States Patent [19]

Forbes, Jr.

[11] Patent Number: 4,474,324

[45] Date of Patent: Oct. 2, 1984

[54] TELESCOPING CARTON

[75] Inventor: Hampton E. Forbes, Jr., Wilmington, Del.

[73] Assignee: Westvaco Corporation, New York, N.Y.

[21] Appl. No.: 469,408

[22] Filed: Feb. 24, 1983

[51] Int. Cl.[3] ..... B65D 5/32

[52] U.S. Cl. ..... 229/23 BT; 220/8; 229/30; 229/37 R

[58] Field of Search ..... 229/23 BT, 23 R, 30, 229/37 R, 31 R, 32, 35; 220/8, 62

[56] References Cited

U.S. PATENT DOCUMENTS

| | | | |
|---|---|---|---|
| 988,015 | 3/1911 | Myers | 229/31 R |
| 2,251,283 | 8/1941 | Johnson | 229/37 R |
| 2,868,429 | 1/1959 | Shanahan | 229/30 |
| 2,994,466 | 8/1961 | Thompson | 229/30 |
| 3,176,900 | 4/1965 | Ciganenko | 229/32 X |
| 3,955,671 | 5/1976 | Ockey | 229/23 BT |

*Primary Examiner*—William Price

*Assistant Examiner*—Gary E. Elkins

[57] ABSTRACT

A telescoping carton particularly adapted for packaging food products is prepared from a pair of combination tray/cover components made from identical blanks of paperboard or the like. Each blank is folded and glued by the manufacturer and shipped to the user in its flattened knocked down condition. The combination tray/cover components have a plurality of side walls and preferably an auto lock bottom. The side walls are joined to one another along score lines to form corners, and the side walls at each corner are provided with a pair of converging score lines which extend from points along the edges of each adjacent side wall toward the corner formed by the adjacent side walls. The corner score lines and the adjacent converging score lines in each side wall form connected, tapered panels. When used as a tray, these panels are pinched together and form outwardly folded corners to effectively reduce the size of the top of the tray. When used as a cover, these same panels are left undisturbed thereby permitting the cover component to telescope over the tray component.

5 Claims, 7 Drawing Figures

TELESCOPING CARTON

BACKGROUND OF INVENTION

Cartons for packaging food products, particularly carryout food products, generally take the form of open mouth scoop type holders or clam shell cartons with integral bottoms and tops. These cartons are provided with tapered side walls so they can be nested and stacked for use. However, all such food products cannot be packaged in the known cartons. Moreover, such cartons do not always provide the protection and strength afforded by telescoping two component cartons. On the other hand, most telescoping two component cartons require one piece to be made larger than the other in order to get the two component to fit over the bottom component. Also, not all available two component cartons can be conveniently stored in a flattened condition for simple and quick set up at the point of use. Accordingly, the present invention was developed to provide an alternative to the known one piece, tapered food cartons available, and to provide such a carton which may be stored in a flattened condition, but which is easy to set up for use. The carton of the present invention is economical to make because both components are identical and it provides a secure enclosure that can be designed for the specific food product to be packaged.

SUMMARY OF INVENTION

The present invention relates to a novel carton for packaging food, and more particularly to a carton formed from separate cover and tray components wherein the cover and tray are each made from identical blanks of paperboard or the like. The combination tray/cover is cut and scored from a substantially rectangular blank of coated paperboard material which is folded and glued by the manufacturer and shipped to the user in a flattened knocked down condition. In the preferred embodiment, the combination tray/cover has an auto lock bottom but another style bottom could be used if desired.

The combination tray/cover comprises a plurality of side walls joined together along score lines to form corners. The side walls at each corner are provided with an additional pair of score lines which extend from points along the edges of each adjacent side wall and converge toward the corner formed by the adjacent side walls. These score lines in conjunction with the corner score lines form connected tapered panels at each corner of the combination tray/cover. When used as a tray, these panels are pinched together to form outwardly folded corners. This step urges the adjacent side walls inwardly to place opposed side walls in converging planes and to effectively reduce the perimeter of the top of the tray as compared with the bottom of the tray. When used as a cover element, the same panels are left undisturbed. Thus the two components, prepared from identical blanks of material, may then be telescoped together to provide a secure enclosure or carton. Since the tray component is slightly smaller than the cover component only in the upper portion thereof, a frictional fit occurs which prevents the cover from telescoping fully over the tray and also allows the two components to be separated from one another when desired. Both components are shipped to the user in their flattened condition where the user may decide which will be a cover and which will be a tray. If desired, appropriate graphics may be provided on the respective components to determine which is a top and which is a bottom. Since the carton is intended for the fast food market, such graphics would make it obvious which component should be used as a tray and which should be used as a cover.

DETAILED DESCRIPTION

Figure 1:
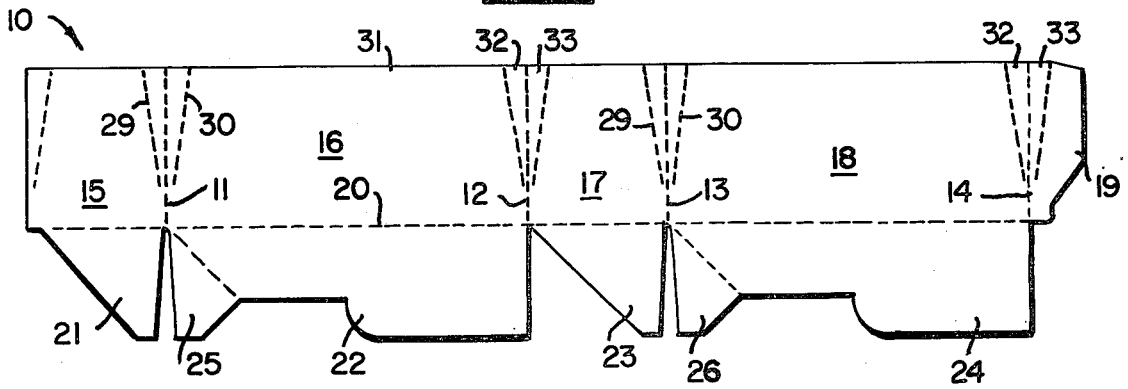
FIG. 1 is a plan view of a typical blank for making the combination tray/cover of the present invention.
Figure 2:
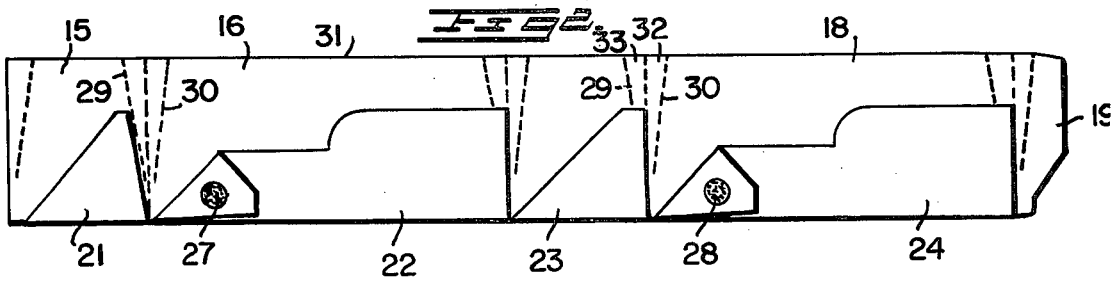
FIG. 2 is a plan view of the blank of FIG. 1 showing a first folding step for making the combination tray/cover of the present invention.

Referring now to the drawings the combination tray/cover disclosed herein may be prepared from a blank as shown in FIG. 1. The blank is preferably cut and scored from light weight coated paperboard for use in making a carton for food products or the like of the carry out variety. For this purpose, the blank 10 is divided by parallel, spaced apart score lines 11, 12, 13 and 14 to define side walls 15, 16, 17 and 18, and a glue flap 19. At the bottom of the blank 10 along score line 20, a plurality of bottom closure flaps 21, 22, 23 and 24 are located which together form a preferred autolock bottom construction. Each of the bottom flaps 22 and 24 include portions 25,26 to which glue is appleid for gluing the bottom together. The glue application 27,28 is shown in FIG. 2. Meanwhile, the side walls 15,16,17 and 18 each include paired converging score lines 29,30 at each corner extending from points along the upper edge 31 of each adjacent side wall toward the corner formed by the adjacent side walls. These score lines are only slightly removed from the respective corners so that they may, in conjunction with the corner scores 11,12,13 and 14, form two connected tapered panels 32,33 at each corner.

Figure 3:
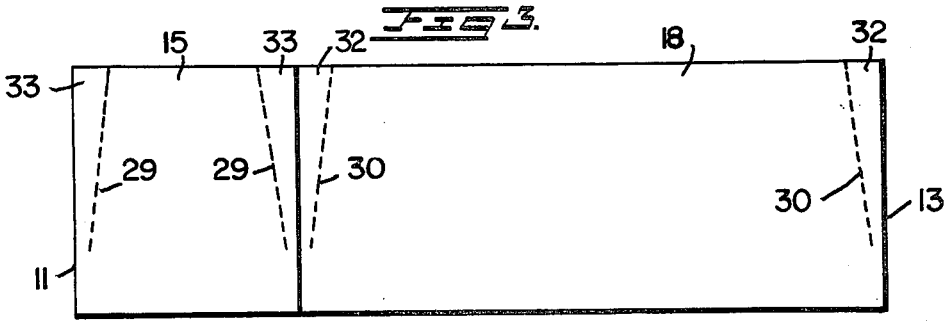
FIG. 3 illustrates the blank of FIG. 1 folded, glued and arranged for shipment in its flattened condition.
Figure 4:
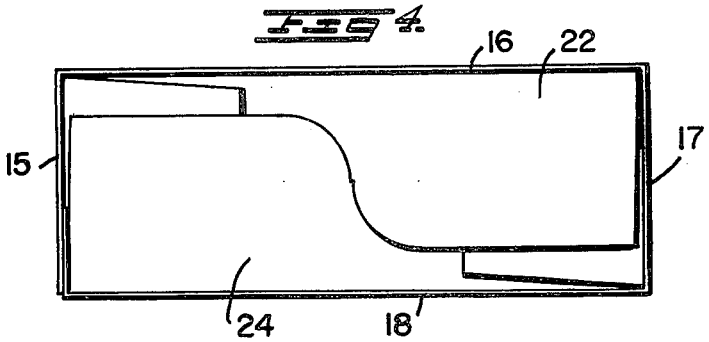
FIG. 4 is an inside view of the squared and set up combination tray/cover showing its preferred self locking bottom construction.

The combination tray/cover is formed by initially folding the bottom closure flaps 21,22,23 and 24 upwardly along score line 20. The portions 25 and 26 of flaps 22,24 are folded downwardly and glue is applied thereto at points 27,28. Subsequently the side wall 18 is folded from right-to-left about score line 13 to adhere the subpanel 26 to panel 23 and in this position, adhesive is applied to glue flap 19 before side wall 15 is folded over from left-to-right to adhere the glue panel 19 to the side wall 15 and the subpanel 25 to panel 21. FIG. 3 shows the blank folded and glued as described above with the blank in its collapsed condition.

At this point, the blank is squared for use by urging the corners 13 and 11 towards one another. In this manner the autolock bottom flaps 22,24 are brought together where they may be retained in position by frictional engagement. It should be understood that the autolock bottom described hereinbefore is merely the preferred bottom for the combination tray/cover components and could be substituted for, if desired, by another form of bottom construction.

Figure 5:
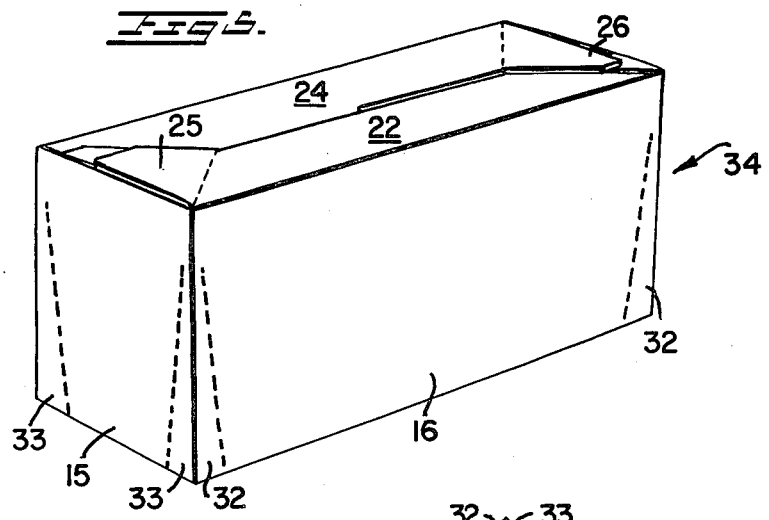
FIG. 5 is a perspective view of the cover component of the carton of the present invention.
Figure 6:
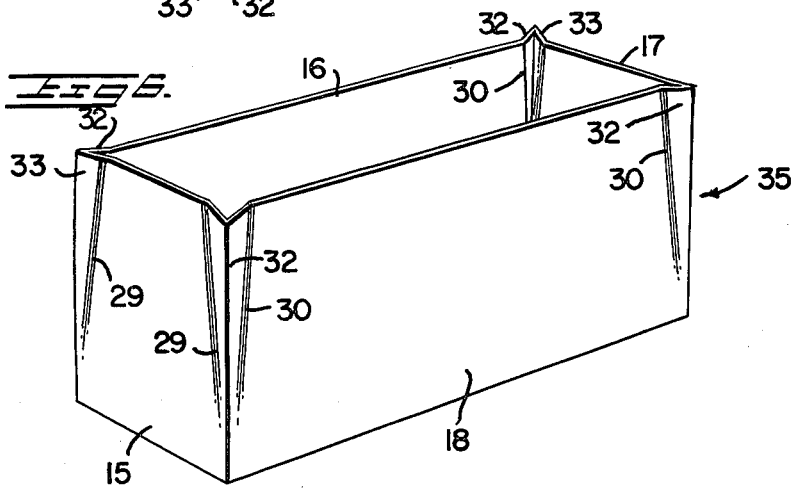
FIG. 6 is a perspective view of the tray component of the carton of the present invention; and, FIG. 7 is a perspective view of the carton with the cover component telescoped over the tray component.
Figure 7:
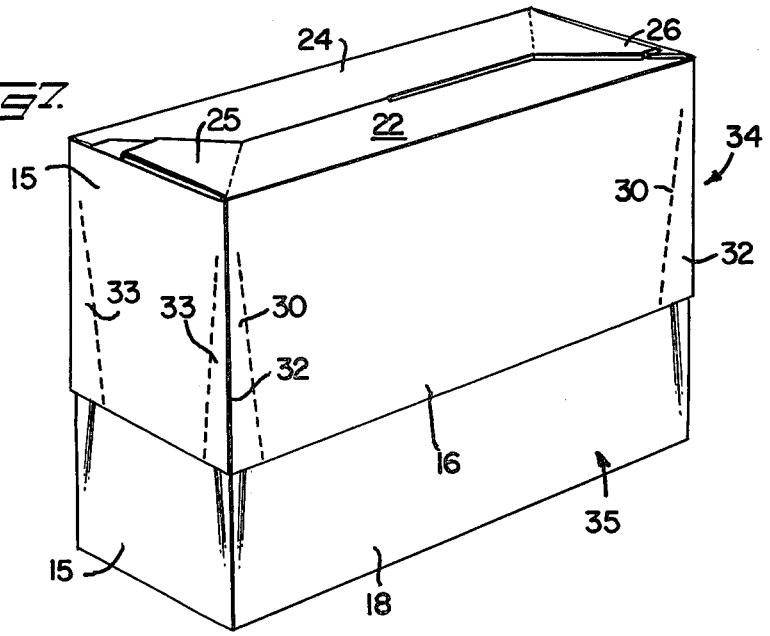

In the squared condition, as shown in FIG. 5, and without additional manipulation, the blank forms the cover component 24 of the present invention. Meanwhile in a similar squared condition, as shown in FIG. 6, and with the corners 11,12,13 and 14 pinched outwardly, the blank forms the tray component 35 of the invention. The tray component is formed by pinching the tapered panels 32,33 at each corner formed by the score lines 11,12,13 and 14, and 29,30 together in order to reduce the external size of the upper edge of the tray 35, thus enabling the cover component 34 to telescope thereover in order to form the completed carton. FIG. 7 shows the carton in its assembled condition with cover element 34 telescoped over tray element 35. It will be noted that because the blanks are the same for both components, the inwardly inclined condition of the side walls 15,16,17 and 18 of tray 35 will only permit a partial telescoping of the cover 34. Accordingly, a snug fit is obtained without damaging the products packaged in the carton.

It will be understood that modifications may be made by those skilled in the art without departing from the spirit and scope of the invention, and that the foregoing specific embodiment is merely illustrative rather than restrictive. It is intended, therefore, that the invention be construed as broadly as possible consistent with the language of the appended claims.

I claim:

1. A tray and cover, each formed from an indentical blank of paperboard or the like and each having four corners formed by first fold lines connecting adjacent side walls, an additional pair of score lines at each corner extending from points along the edge of each adjacent side wall and converging toward the corner formed by the adjacent side walls, said converging score lines and corner score lines forming connected, tapered panels at each corner, said tapered panels being pinched together to produce outwardly folded corners and inwardly inclined side walls to effectively reduce the external size of the tray component whereas the same panels are left undisturbed in the cover component.

2. The tray and cover of claim 1 wherein the additional paired score lines at each corner of each component are oriented in substantially the same angular relation with respect to the corner score lines.

3. The tray and cover of claim 2 wherein each component has an auto lock bottom structure.

4. A telescoping carton comprising a tray component and cover component each having the same cross sectional shape, said tray and cover each being prepared from identical blanks of paperboard or the like and having the same number of corners, said corners being formed by score lines connecting adjacent side walls together, a pair of converging score lines at each corner extending from points along the edge of each adjacent side wall toward the corner formed by the adjacent side walls said converging score lines and corner score lines forming connected, tapered panels at each corner, said tapered panels being pinched together to produce outwardly folded corners to effectively reduce the external size of the tray component whereas the same panels are left undisturbed in the cover component thereby permitting the cover component to telescope over the tray component.

5. The carton of claim 4 wherein each component is provided with an auto lock bottom so that said folded and glued blanks may be stored in a knocked down, flattened condition.

* * * * *